US007275772B2

(12) United States Patent
Lee

(10) Patent No.: US 7,275,772 B2
(45) Date of Patent: Oct. 2, 2007

(54) HANDLE OF A VEHICLE DOOR

(75) Inventor: Sang Yun Lee, Jeju-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/303,123

(22) Filed: Dec. 14, 2005

(65) Prior Publication Data

US 2007/0138811 A1 Jun. 21, 2007

(30) Foreign Application Priority Data

Dec. 13, 2005 (KR) ..... 10-2005-0122324

(51) Int. Cl.
*E05B 3/00* (2006.01)

(52) U.S. Cl. ..... 292/336.3; 292/348; 292/DIG. 56; 292/DIG. 64

(58) Field of Classification Search ..... 292/336.3, 292/348
See application file for complete search history.

(56) References Cited

U.S. PATENT DOCUMENTS 6,401,302 B1 * 6/2002 Josserand et al. ..... 16/444
7,011,349 B2 * 3/2006 Nomura et al. ..... 292/347
2005/0236846 A1 * 10/2005 Hidaka et al. ..... 292/216
2005/0275226 A1 * 12/2005 Watanabe et al. ..... 292/216
2006/0091680 A1 * 5/2006 Cummins et al. ..... 292/336.3

FOREIGN PATENT DOCUMENTS

JP 2000-318657 11/2000
JP 2003-013629 1/2003
JP 2003-247356 9/2003

* cited by examiner

*Primary Examiner*—Brian E. Glessner
*Assistant Examiner*—Kristina R Gluchowski
(74) *Attorney, Agent, or Firm*—Peter F. Corless; Edwards Angell Palmer & Dodge LLP

(57) ABSTRACT

A handle of a vehicle door of the present invention includes a base, a cover, a grip, and an aligner. The base is mounted on an interior side of a door panel. The cover is assembled to the base through the door panel. The grip is assembled to the base through the door panel. The aligner is disposed on the grip adjacent to the cover, such that a gap between the cover and the grip is maintained as a first predetermined gap when the cover and the grip are assembled to the base.

4 Claims, 5 Drawing Sheets

HANDLE OF A VEHICLE DOOR

CROSS-REFERENCE TO RELATED APPLICATION

This application claims priority to and the benefit of Korean Patent Application No. 10-2005-0122324 filed in the Korean Intellectual Property Office on Dec. 13, 2005, the entire contents of which are incorporated herein by reference.

BACKGROUND OF THE INVENTION (a) Field of the Invention

The present invention relates to a vehicle door, and in particular, to a handle of a vehicle door having a structure in which a cover and a grip are separated from each other.

(b) Description of the Related Art

In general, a vehicle door includes a door panel and a handle mounted on the door panel.

In addition, the handle of a vehicle door includes a locking part, a cover covering the locking part, and a grip. The grip is disposed apart from the cover by a predetermined gap, and it is to be directly pulled by a hand.

Such a handle of a vehicle door is assembled as follows.

First, a base is mounted into the door panel. In particular, a mechanism for connecting the locking part to the grip is mounted on the base.

In addition, the grip is mounted on the base through the door panel, and thereafter, the cover is mounted on the base through the door panel.

However, the conventional handle of a vehicle door may have the following problems.

It may be difficult for a gap between the cover and the grip to be maintained as a predetermined gap because of assembling allowances. Such assembling allowances include a first assembling allowance when the base is assembled to the door panel, a second assembling allowance when the grip is assembled to the base, and a third assembling allowance when the cover is assembled to the base.

Furthermore, it may be more difficult for a gap between the cover and the grip to be maintained as the predetermined gap because of design tolerances of the cover and the grip.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a handle of a vehicle door having advantages of maintaining a gap between a cover and a grip as a predetermined gap.

A handle of a vehicle door according to an embodiment of the present invention includes a base which is mounted on an interior side of a door panel; a cover which is assembled to the base through the door panel; a grip which is assembled to the base through the door panel; and an aligner which is disposed on the grip adjacent to the cover, such that a gap between the cover and the grip is maintained as a first predetermined gap when the cover and the grip are assembled to the base.

In a further embodiment, the aligner includes an insertion cavity which is formed at a portion adjacent to the cover of the grip; a body, one end of which is inserted into the insertion cavity; and a regulator for regulating insertion extent of the body according to first and second predetermined pressures which are applied to the body.

In a further embodiment, the regulator includes a plurality of projections which are projected from the one end of the body; a first catch detent which is formed on an interior surface of the insertion cavity of the grip; and a first catch prominence which is formed on the plurality of projections. The first catch prominence stops at a front surface of the first catch detent with respect to an insertion direction when the body is inserted by the first predetermined pressure; and it is positioned to a rear surface of the first catch detent with respect to the insertion direction when the body is pressed by the second predetermined pressure.

In a further embodiment, the plurality of projections are respectively provided to the one end of the body with a second predetermined gap defined such that the first catch prominence smoothly passes through the first catch detent when the body is pressed by the second predetermined pressure.

In a further embodiment, the aligner further comprises a separation preventing part for preventing the body from being separated from the insertion cavity, in a state in which the body is inserted into the insertion cavity by the first predetermined pressure.

In a further embodiment, the separation preventing part includes a second catch prominence which is formed on one side surface of the body; and a second catch detent which is formed on an interior surface of the insertion cavity of the grip corresponding to the second catch prominence.

In a further embodiment, the aligner further includes a fixing part for fixing the body so as to prevent the body from moving left and right, in a state in which the first catch prominence is positioned to the rear surface of the first catch detent, after the body is pressed by the second predetermined pressure.

In a further embodiment, the fixing part includes a third catch detent which is formed on an interior surface of the insertion cavity of the grip such that the one end of the body contacts one surface thereof when the first catch prominence is positioned to the rear surface of the first catch detent.

DESCRIPTION OF REFERENCE NUMERALS INDICATING PRIMARY ELEMENTS IN THE DRAWINGS

| | |
|---|---|
| 100: base | 300: cover |
| 500: grip | 700: aligner |
| 710: insertion cavity | 730: body |
| 750: regulator | 751: projection |
| 753: first catch detent | 755: first catch prominence |

DETAILED DESCRIPTION OF THE EMBODIMENTS

With reference to the accompanying drawings, the present invention will be described in order for those skilled in the art to be able to implement the invention. As those skilled in the art would realize, the described embodiments may be modified in various different ways, all without departing from the spirit or scope of the present invention.

Figure 1:
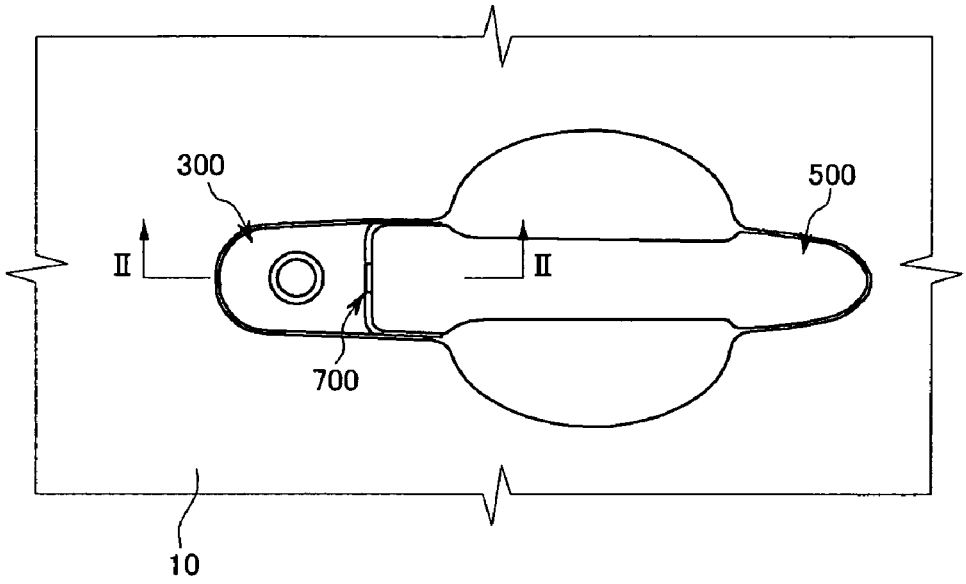
FIG. 1 is a schematic view showing a handle of a vehicle door according to an embodiment of the present invention.
Figure 2:
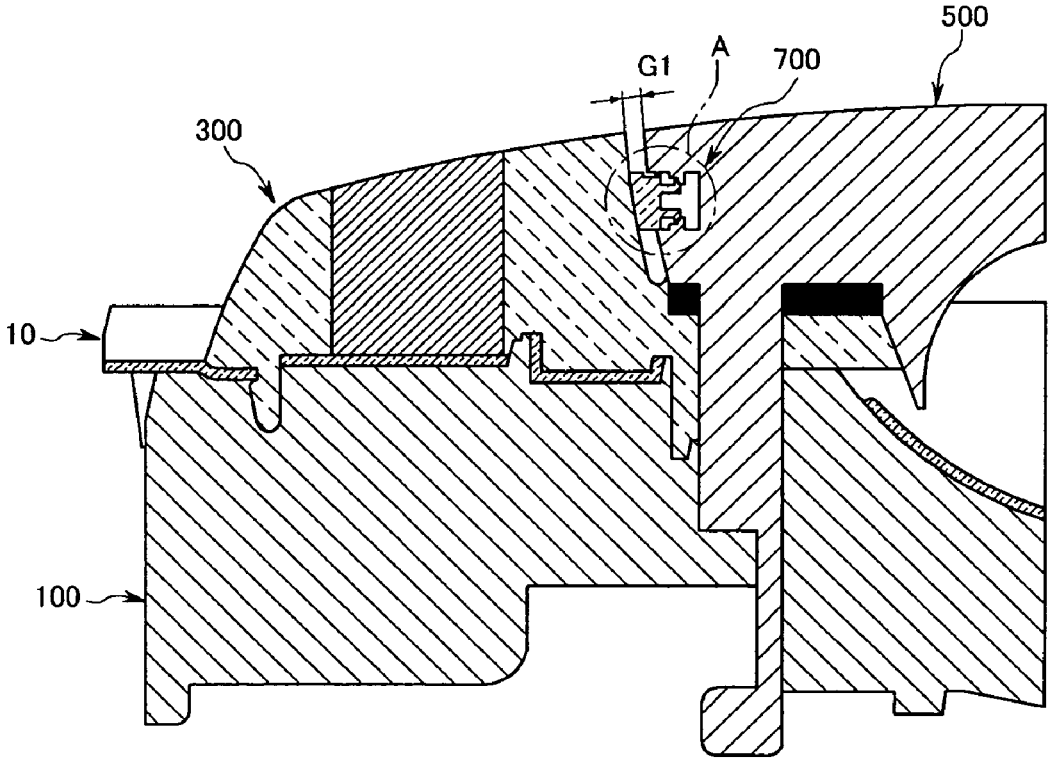
FIG. 2 is a cross-sectional view of line II-II in FIG. 1.
Figure 3:
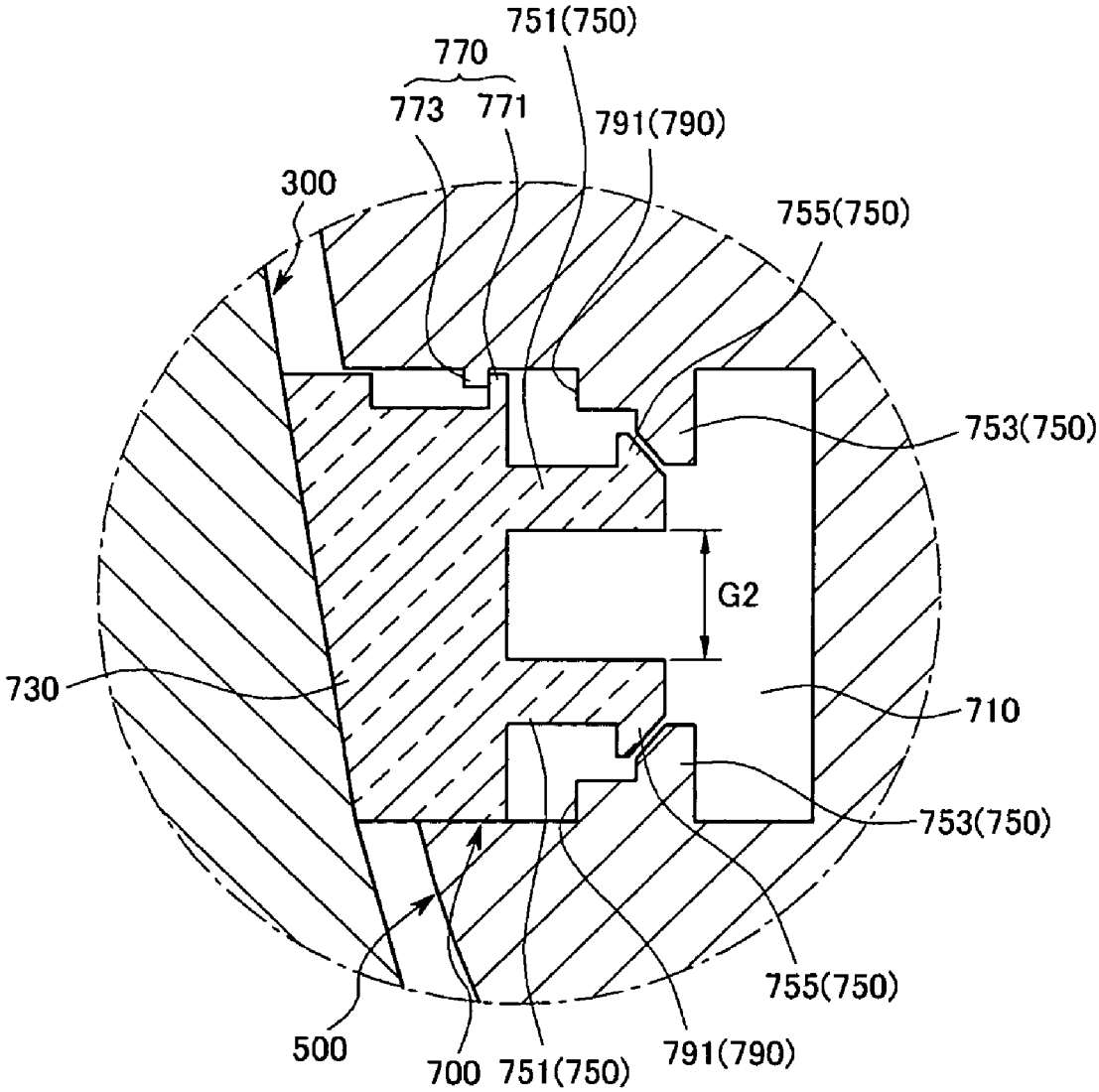
FIG. 3 is an enlarged view of "A" part in FIG. 2.

FIG. 1 is a schematic view showing a handle of a vehicle door according to an embodiment of the present invention, FIG. 2 is a cross-sectional view of line II-II in FIG. 1, and FIG. 3 is an enlarged view of the "A" part in FIG. 2.

Figure 4:
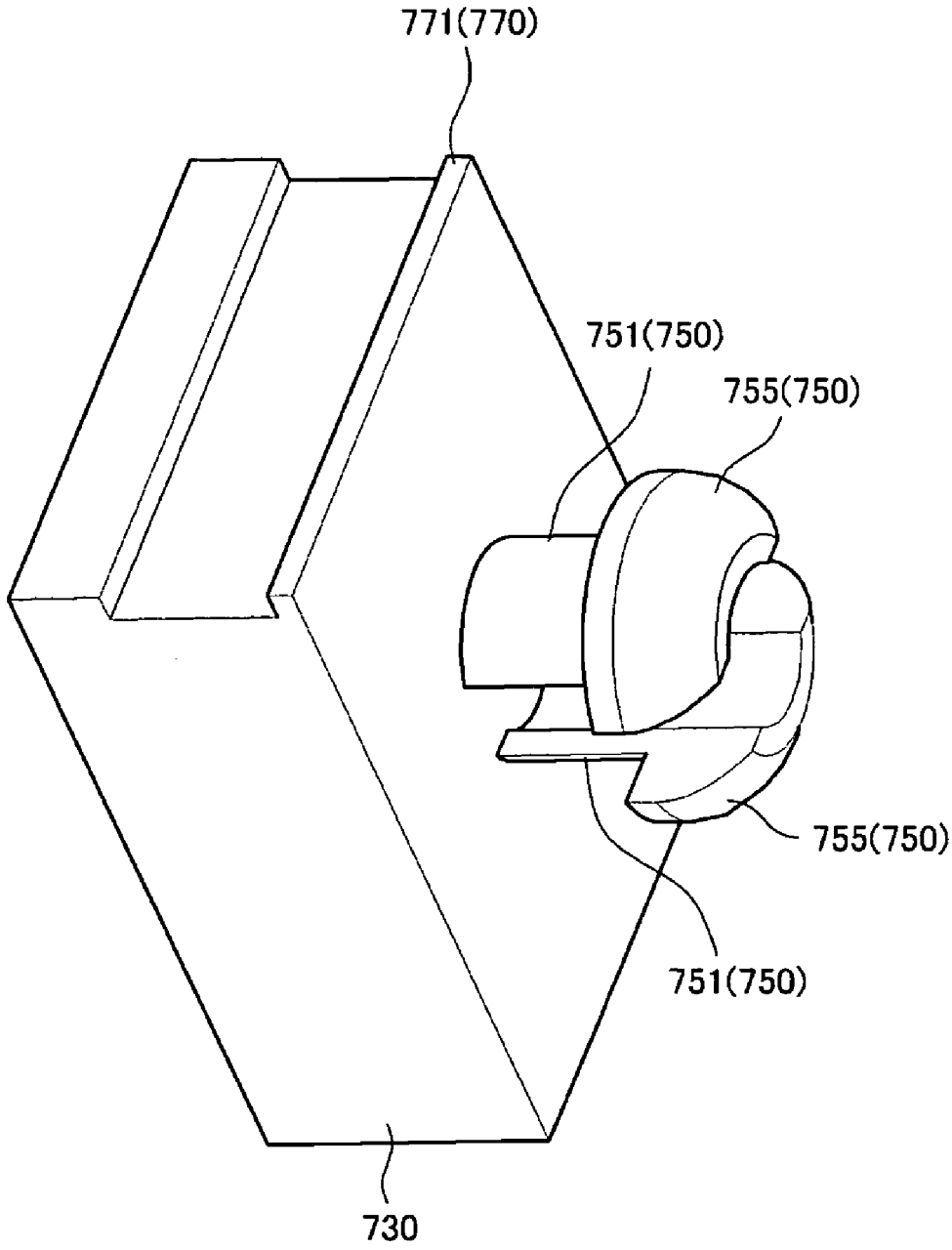
FIG. 4 is a perspective view showing an aligner in a handle of a vehicle door according to an embodiment of the present invention.

FIG. 4 is a perspective view showing an aligner in a handle of a vehicle door according to an embodiment of the present invention.

A handle of a vehicle door according to an embodiment of the present invention, as shown in FIGS. 1 and 2, includes a base 100, a cover 300, a grip 500, and an aligner 700.

The base 100 is mounted on an interior side of a door panel 10.

The cover 300 is assembled to the base 100 through the door panel 10. In more detail, the cover 300 is inserted into the base 100 and is coupled to one side of the base 100 by a bolt (not shown).

The grip 500 is assembled to the base 100 through the door panel 10. In more detail, after the cover 300 is coupled to the base 100, the grip 500 is inserted into the base 100 and is coupled by a bolt (not shown).

The aligner 700 is disposed on the grip 500 that is adjacent to the cover 300, and it maintains a gap between the cover and the grip as a first predetermined gap G1 when the cover 300 and the grip 500 are assembled to the base 100.

With reference to FIGS. 3 and 4, the aligner 700 will be described hereinafter.

The aligner 700 includes an insertion cavity 710, a body 730, and a regulator 750.

The insertion cavity 710 is formed at a portion adjacent to the cover 300 of the grip 500. One end of the body 730 is inserted into the insertion cavity 710, and the other end is projected outward with respect to an exterior surface of the grip 500 by the first predetermined gap G1.

The regulator 750 regulates the insertion extent of the body 730 according to first and second predetermined pressures which are applied to the body 730. That is, the regulator 750 may project the body 730 outward with respect to an exterior surface of the grip 500 by the first predetermined gap G1, and it may completely insert the body 730 into the insertion cavity 710. The regulator 750 will hereinafter be described in detail.

The regulator 750 may include a plurality of projections 751, a first catch detent 753, and a first catch prominence 755.

The plurality of projections 751 are projected from the one end of the body 730. In more detail, the plurality of projections 751 are projected along the insertion direction of the body 730. The first catch detent 753 is formed on an interior surface of the insertion cavity 710 of the grip 500.

The first catch prominence 755 is formed on the plurality of projections 751. In more detail, the first catch prominence 755 stops at a front surface of the first catch detent 753 with respect to the insertion direction when the body 730 is inserted into the insertion cavity 710 by the first predetermined pressure, and it is positioned to a rear surface of the first catch detent 753 with respect to the insertion direction when the body 730 is pressed by the second predetermined pressure.

Here, the first predetermined pressure is a pressure through which the cover 300 is pressed by the grip 500 when the grip 500 is coercively inserted into the base 100. The second predetermined pressure is higher that the first predetermined pressure, and it is pressure by which the body 730 is easily inserted into the insertion cavity 710 when a worker presses the body 730.

In addition, the plurality of projections 751 may be respectively provided to the one end of the body 730 with a second predetermined gap G2 defined such that the first catch prominence 755 smoothly passes through the first catch detent 753 when the body 730 is pressed by the second predetermined pressure. As an example, there may be two of the plurality of projections 751, and a gap therebetween may be the second predetermined gap G2.

In addition, the aligner 700 may further include a separation preventing part 770 for preventing the body 730 from being separated from the insertion cavity 710, in a state in which the body 730 is inserted into the insertion cavity 710 by the first predetermined pressure.

As an example, the separation preventing part 770 may include a second catch prominence 771 and a second catch detent 773. The second catch prominence 771 is formed on one side surface of the body 730. The second catch detent 773 is formed on an interior surface of the insertion cavity 710 of the grip 500 corresponding to the second catch prominence 771. If the body 730 is inserted into the insertion cavity 710 by the first predetermined pressure, the second catch detent 773 contacts a rear surface of the second catch prominence 771 with respect to the insertion direction of the body 730.

In addition, the aligner 700 may further include a fixing part 790 for fixing the body 730 so as to prevent the body 730 from moving left and right, in a state in which the first catch prominence 755 is positioned to the rear surface of the first catch detent 753 after the body 730 is pressed by the second predetermined pressure.

As an example, the fixing part 790 may include a third catch detent 791 which is formed on an interior surface of the insertion cavity 710 of the grip 500 such that the one end of the body 730 contacts one surface thereof when the first catch prominence 755 is positioned to the rear surface of the first catch detent 753.

Figure 5:
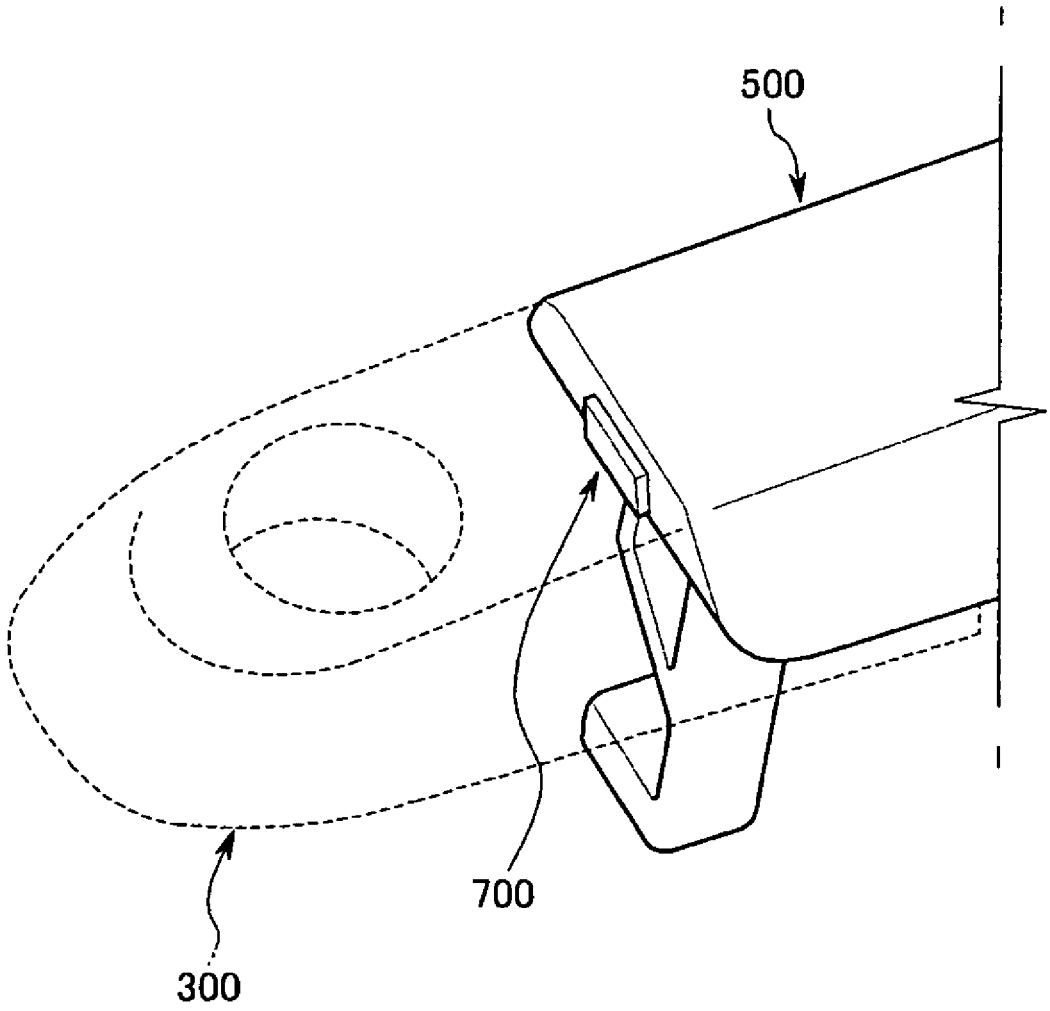
FIG. 5 is a perspective view showing a principal part of FIG. 1.
Figure 6:
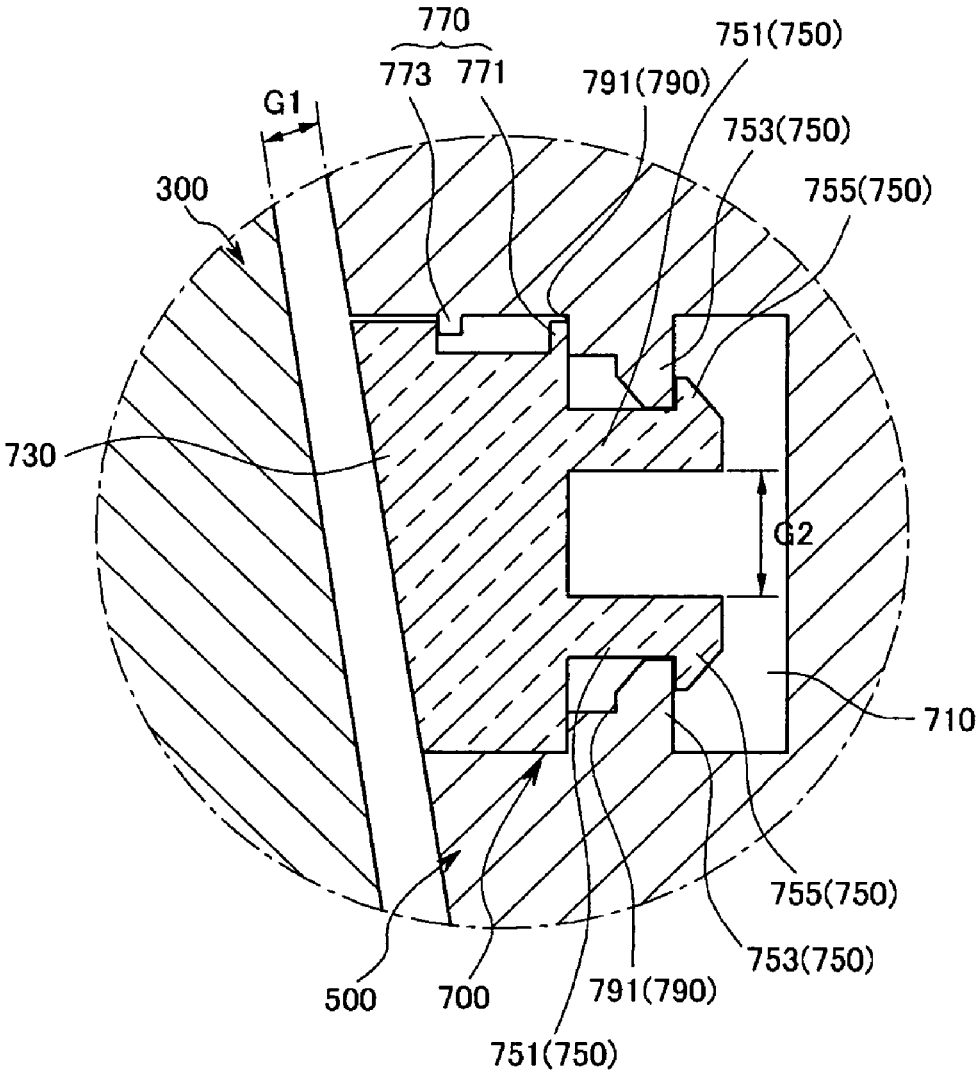
FIG. 6 shows a state in which a body is inserted into an insertion cavity, in a handle of a vehicle door according to an embodiment of the present invention.

FIG. 5 is a perspective view showing a principal part of FIG. 1. FIG. 6 shows a state in which a body is inserted into an insertion cavity, in a handle of a vehicle door according to an embodiment of the present invention.

With reference to FIGS. 3, 5 and 6, a function of the aligner 700 of the handle of a vehicle door according to an embodiment of the present invention will hereinafter be described in detail.

First, if the body 730 is inserted into the insertion cavity 710 by the first predetermined pressure, the first catch prominence 755 stops at the front surface of the first catch detent 753. In addition, the second catch prominence 771 contacts the rear surface of the second catch detent 773. Consequently, the body 730 is completely fixed to the insertion cavity 710.

In addition, the grip 500 is coercively inserted into the base 100 to which the cover 300 has been already assembled, and is coupled by a bolt (not shown). At the same time, a gap between the cover 300 and grip 500 is maintained as the first predetermined gap G1 by the body 730 positioned between the cover 300 and the grip 500.

Thereafter, if a worker pulls the grip 500 and pushes the body 730 by the second predetermined pressure, the plurality of projections 751 are contracted toward a center thereof, and accordingly the first catch prominence 755 smoothly passes through the first catch detent 753. In addition, after passing through the first catch detent 753, the first catch prominence 755 contacts the rear surface of the first catch detent 753. In addition, the one end of the body 730 stops at the third catch detent 791. As a result, the body 730 is completely fixed to the insertion cavity 710.

As has been explained, the handle of a vehicle door according to an exemplary embodiment of the present invention may have the following advantages.

According to the embodiment of the present invention, a gap between a cover and a grip can be maintained as a predetermined gap.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A handle of a vehicle door, comprising:

a base which is mounted on an interior side of a door panel;

a cover which is assembled to the base through the door panel;

a grip which is assembled to the base through the door panel;

an aligner which is disposed on the grip adjacent to the cover, such that a gap between tho cover and the grip is maintained as a first predetermined gap when the cover and the grip are assembled to the base, the aligner comprising an insertion cavity which is formed at a portion adjacent to the cover of the grip; a body, one end of which is inserted into the insertion cavity; and a regulator for regulating an insertion extent of the body according to first and second predetermined pressures which are applied to the body;

the regulator comprising a plurality of projections which are projected from the one end of the body; a first catch detent which is formed on an interior surface of the insertion cavity formed at a portion adjacent to the cover of the grip; and a first catch prominence which is formed on each of the plurality of projections, wherein the first catch prominence stops at a front surface of the first catch detent with respect to an insertion direction when the body is inserted by the first predetermined pressure, and the first catch prominence is positioned to a rear surface of the first catch detent with respect to the insertion direction when the body is pressed by the second predetermined pressure; and the plurality of projections are respectively provided to the one end of the body with a second predetermined gap between the plurality of projections, such that the first catch prominence smoothly passes through the first catch detent when the body is pressed by the second predetermined pressure.

2. A handle of a vehicle door, comprising: a base which is mounted on an interior side of a door panel; a cover which is assembled to the base through the door panel; a grip which is assembled to the base through the door panel; an aligner which is disposed on the grip adjacent to the cover, such that a gap between the cover and the grip is maintained as a first predetermined gap when the cover and the grip are assembled to the base, the aligner comprising an insertion cavity which is formed at a portion adjacent to the cover of the grip; a body, one end of which is inserted into the insertion cavity; a regulator for regulating an insertion extent of the body according to first and second predetermined pressures which are applied to the body; and a separation preventing part for preventing the body from being separated from the insertion cavity, in a state in which the body is inserted into the insertion cavity by the first predetermined pressure; the regulator comprising a plurality of projections which are projected from the one end of the body; a first catch detent which is formed on an interior surface of the insertion cavity formed at a portion adjacent the cover of the grip; and a first catch prominence which is formed on each of the plurality of projections, and wherein the first catch prominence stops at a front surface of the first catch detent with respect to an insertion direction when the body is inserted by the first predetermined pressure, and the first catch prominence is positioned to a rear surface of the first catch detent with respect to the insertion direction when the body is pressed by the second predetermined pressure; the separation preventing part comprising a second catch prominence which is formed on one side surface of the body; and a second catch detent which is formed on an interior surface of the insertion cavity formed at a portion adjacent to the cover of the grip corresponding to the second catch prominence.

3. A handle of a vehicle door, comprising: a base which is mounted on an interior side of a door panel; a cover which is assembled to the base through the door panel; a grip which is assembled to the base through the door panel; and an aligner which is disposed on the grip adjacent to the cover, such that a gap between the cover and the grip is maintained as a first predetermined gap when the cover and the grip are assembled to the base; the aligner comprising an insertion cavity which is formed at a portion adjacent to the cover of the grip; a body, one end of which is inserted into the insertion cavity; and a regulator for regulating an insertion extent of the body according to first and second predetermined pressures which are applied to the body; the regulator comprising a plurality of projections which are projected from the one end of the body; a first catch detent which is formed on an interior surface of the insertion cavity formed at a portion adjacent to the cover, of the grip; and a first catch prominence which is formed on each of the plurality of projections, and wherein the first catch prominence stops at a front surface of the first catch detent with respect to an insertion direction when the body is inserted by the first predetermined pressure, and the first catch prominence is positioned to a rear surface of the first catch detent with respect to the insertion direction when the body is pressed by the second predetermined pressure; the aligner further comprising a fixing part for fixing the body so as to prevent the body from moving left and right, in a state in which the first catch prominence is positioned to the rear surface of the first catch detent, after the body is pressed by the second predetermined pressure.

4. The handle of claim 3, wherein the fixing part comprises a third catch detent which is formed on an interior surface of the insertion cavity of the grip such that the one end of the body contacts one surface thereof when the first catch prominence is positioned to the rear surface of the first catch detent.

* * * * *